US009125461B2

(12) United States Patent
Liberman et al.

(10) Patent No.: US 9,125,461 B2
(45) Date of Patent: Sep. 8, 2015

(54) GEAR NECKLACE SYSTEM

(71) Applicant: Kinekt Design, LLC, Livingston, NJ (US)

(72) Inventors: Rachel Liberman, Short hills, NJ (US); Julie Liberman, Berkeley, CA (US); Lucas Taylor, Easton, PA (US)

(73) Assignee: Kinekt Design, LLC, Livingston, NJ (US)

( * ) Notice: Subject to any disclaimer, the term of this patent is extended or adjusted under 35 U.S.C. 154(b) by 24 days.

(21) Appl. No.: 13/755,707

(22) Filed: Jan. 31, 2013

(65) Prior Publication Data

US 2014/0212856 A1 Jul. 31, 2014

(51) Int. Cl.

| | |
|---|---|
| ***A44C 15/00*** | (2006.01) |
| ***A44C 11/00*** | (2006.01) |
| *A44C 23/00* | (2006.01) |

(52) U.S. Cl.

CPC ..... *A44C 15/005* (2013.01); *A44C 11/005* (2013.01); *A44C 23/00* (2013.01)

(58) Field of Classification Search

CPC ..... A63B 21/00; A44C 5/00; A44C 9/00; A44C 15/005

USPC ..... 63/3; 434/247, 258; 482/44, 49, 148

See application file for complete search history.

(56) References Cited

U.S. PATENT DOCUMENTS

| | | | | |
|---|---|---|---|---|
| 1,451,797 | A * | 4/1923 | Wattie | 139/77 |
| 5,893,203 | A * | 4/1999 | Buttrick Jr. | 29/407.05 |
| 2012/0090356 | A1 * | 4/2012 | Liberman et al. | 63/3 |

OTHER PUBLICATIONS

"Block and Tackle Pulley Heart Pendant," Green Tree Jewelry, http://web.archive.org/web/20120211070450/http://www.greentreejewelry.com/gear-garb/block-and-tackle-pulley-heart-pendent.html, Feb. 11, 2012.*

"Block and Tackle Pulley Heart Pendant Red," http://www.shakedowngoods.com/wood-jewelry-and-accessories.html.*

"Jon Bondy's Web Site," Jon Bondy, http://web.archive.org/web/20071127031346/http://www.jonbondy.com/creations.htm, Nov. 27, 2007.*

"Shiploading: A Picture-Dictionary of Shiploading Terms," http://web.archive.org/web/20120721050436/http://www.history.navy.mil/library/online/shiploading_dic.htm, Jul. 21, 2012.*

"What a great honor," Cindy Kovar Pottery Bead Artist, http://blogforbeads.blogspot.com/2013_01_01_archive.html, Jan. 13, 2013.*

"Web Cam Support," www.wildrice.com, https://web.archive.org/web/19981203100016/http://www.wildrice.com/Servo/webcam.html, Dec. 3, 1998.*

* cited by examiner

*Primary Examiner* — Sam Yao
*Assistant Examiner* — Jennifer L Fassett
(74) *Attorney, Agent, or Firm* — Brouse McDowell; Michael G. Craig

(57) ABSTRACT

A necklace that contains a gear assembly within a housing where gears of the gear assembly are rotated by a driving component. The driving component is a necklace chain where the chain, for example is a ball chain or a box chain that passes through openings in a housing wall and is configured to physically rotate gears.

12 Claims, 4 Drawing Sheets

GEAR NECKLACE SYSTEM

FIELD OF THE INVENTION

The invention relates generally to a decorative, wearable and ornamental geared device usable as a necklace or other piece of jewelry, a toy, a therapy tool, and more specifically to a necklace with a gear assembly housing and chain driven gear assembly through which a ball chain moves and rotates the contained gear assembly.

BACKGROUND OF THE INVENTION

The present invention relates generally to jewelry, decorative wearable items, educational toys, physical or mental therapy tools, and more particularly to a heart shaped housing with a gear assembly which readily rotates utilizing a ball chain necklace. Although the prior art teaches many devices for use as decorative jewelry, all of these teachings demonstrate limitations that the present invention addresses and overcomes.

Toys, jewelry, wearable items, educational toys, physical or mental therapy tools, and other tools with rotation features are well known in the art. Gear assemblies with a plurality of mechanisms have many uses as toys or other tools for improving many devices.

U.S. Pat. No. 3,486,269 to Fischer describes a wheel capable of transmitting motion through friction as it contacts a second rotary element for use in devices such as toys. This allows for the construction of toys where the accuracy of gear transmission is not necessary in order to keep construction and manufacturing costs down. However, this invention is not well suited to use as a heart shaped gear assembly necklace or piece of wearable jewelry as it teaches motion transmission for the purpose of performing work to drive a gear shaft. Also, there is no teaching that this mechanism may have use for mental stimulation or therapy purposes.

In another example, U.S. Pat. No. 5,194,031 to Sahler, a ring gear assembly as part of a toy used for amusement and educational purposes is described. The device is purportedly useful as an educational tool for teaching the relationship between a ring gear and a drive gear to demonstrate rotational motion. However, this invention also has limitations that would restrict its use as a piece of wearable jewelry or as an easily portable therapy device. This device requires the gear mechanisms to be mounted to a board in a specific relationship to each other. Therefore, it is not wearable or portable by design.

Despite the prior art, there is still a need for additional jewelry and entertaining devices which utilize rotation elements to produce movement. An additional need exists for devices that teach basic mechanical associations such as a gear and cog mechanism to promote education in the science and engineering fields in a simple and engaging manor. There is also a need for wearable devices designed as a physical therapy tool to help improve or maintain fine motor function as people age or otherwise begin to lose or have lost "normal mental/motor function." Another need exists for wearable movable devices that are helpful with the relief of stress or anxiety such as for people affected by obsessive compulsive disorder or attention deficit disorder. An additional rehabilitative need exists for a device that may improve or maintain cognitive function for individuals who have declining cognitive states whether from natural causes, brain injury, or disease such as Alzheimer's disease. Finally, there is always a need for decorative wearable jewelry capable of identification of affection, capable of taking hold of attention, that is visually pleasing, movable, enjoyable to wear and distinctive.

SUMMARY OF THE INVENTION

Accordingly, the present invention overcomes the limitations of the prior art by providing a necklace with a heart shaped housing and moveable enclosed gear assembly through which a ball chain necklace moves and rotates the contained gear assembly. Accordingly it is a primary object of the invention to provide a new interactive and educational gear assembly device capable of demonstrating basic mechanical movements that may be worn on an appendage as a piece of decorative art, a unique necklace and unique jewelry. In the preferred embodiment the housing that contains the gear assembly is shaped like a heart.

Consequently, the following presents a simplified summary of the invention in order to provide a basic understanding of some aspects of the invention. This summary is not an extensive overview of the invention. It is intended to neither identify key or critical elements of the invention nor delineate the scope of the invention. Its purpose is to present some concepts of the invention in a simplified form as to preclude the more detailed description that is presented later.

It is an object of the present invention to provide a device useable as a decorative moveable gear assembly necklace with a heart shaped housing and gear assembly through which a ball chain necklace moves and rotates the contained gear assembly(s).

It is another object of the invention to provide a toy gear assembly in the form of a wearable piece of jewelry.

Another object of the invention is to provide a device for exercising and improving fine motor and cognitive skills.

An even further object of the present invention is to provide a toy gear assembly comprising a moveable gear assembly through which a ball chain necklace moves and rotates the contained gear assemblies.

It is a further object of the invention to provide a therapeutic treatment for stress or anxiety.

An even further object of the invention is to provide an educational tool for a mechanical rotational motion.

An additional object of the invention is to provide a method of maintaining or improving motor or cognitive skills by manipulating a rotatable gear assembly.

Another object of the invention is to provide a form of entertainment.

It is yet another object of the invention to provide a method of therapeutic relaxation.

Another object of the invention is to provide a movable piece of jewelry.

Figure 1:
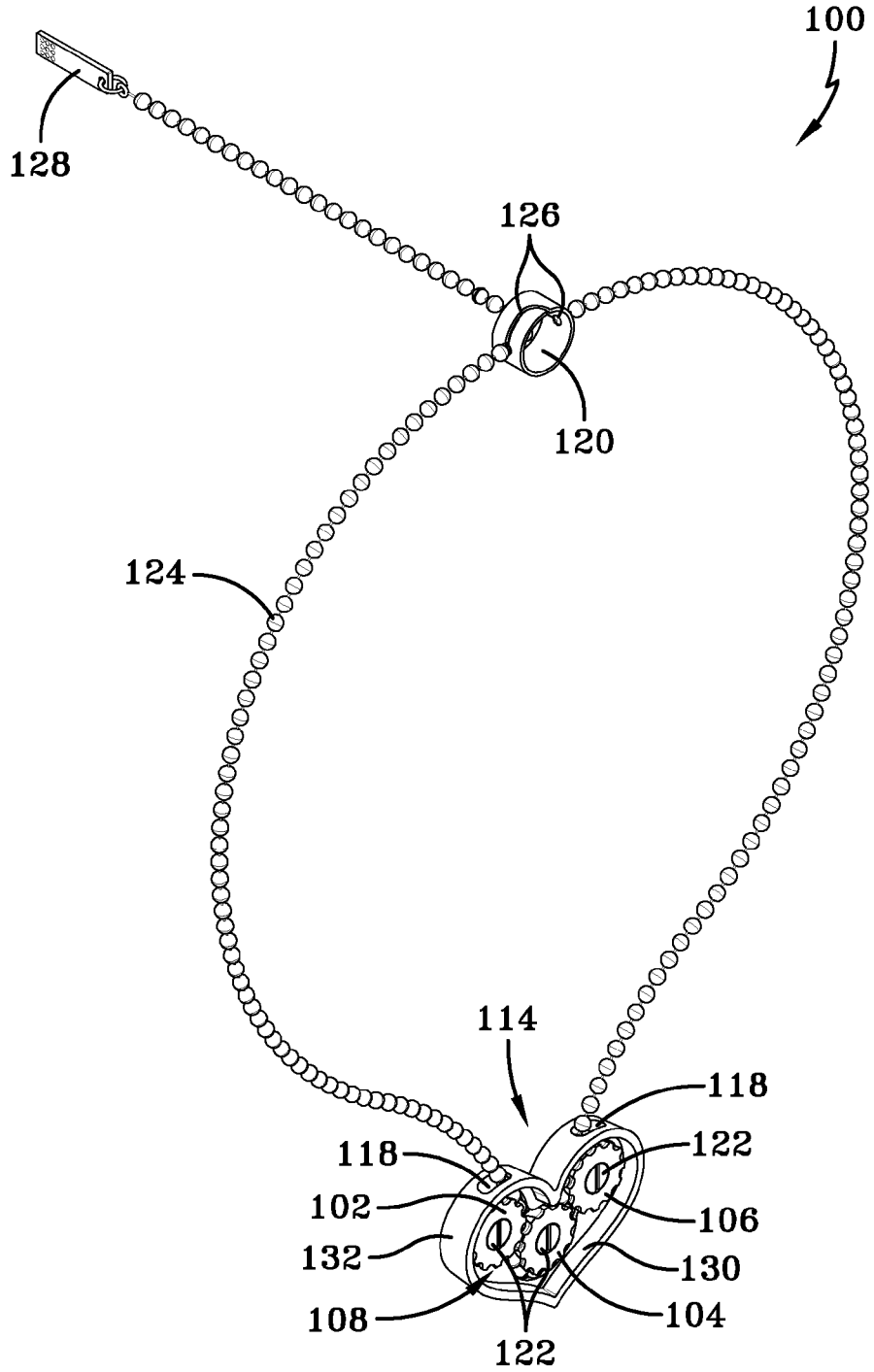
FIG. 1 is an upper right front perspective view of a gear assembly within a heart necklace housing showing our new design.

The objects shown in broken, phantom lines are shown for environmental purposes only and form no part of the claimed design.

DETAILED DESCRIPTION OF THE INVENTION

One or more implementations of the present invention will now be described with reference to the attached drawings, wherein like reference numerals are used to refer to like elements throughout. The gear assembly of the present invention is adapted to supply a variety of amusing, educational, and therapeutic devices which do not currently exist, jewelry and unique moveable jewelry.

Figure 2:
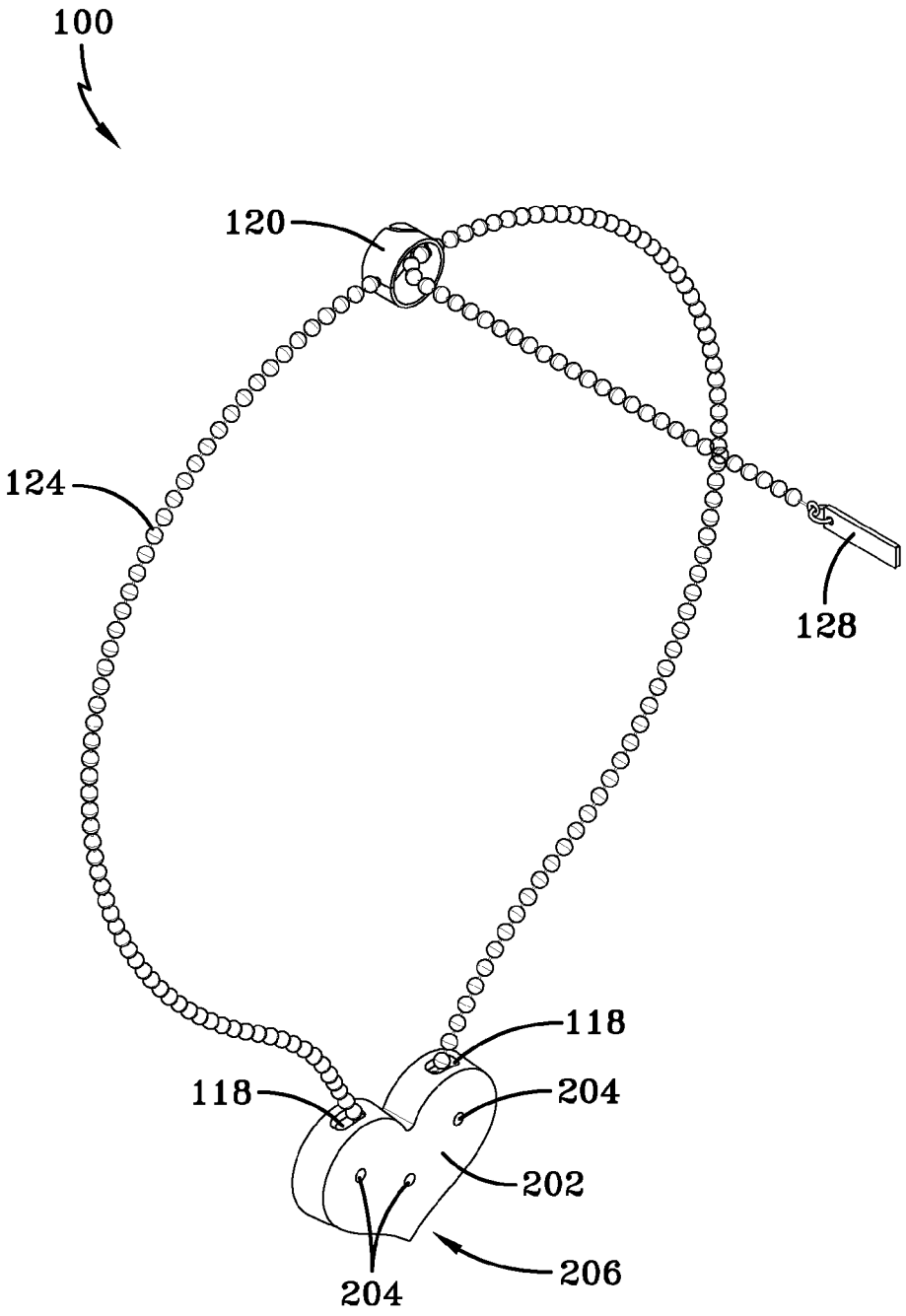
FIG. 2 is a rear upper left perspective view of the gear heart necklace shown in FIG. 1.
Figure 3:
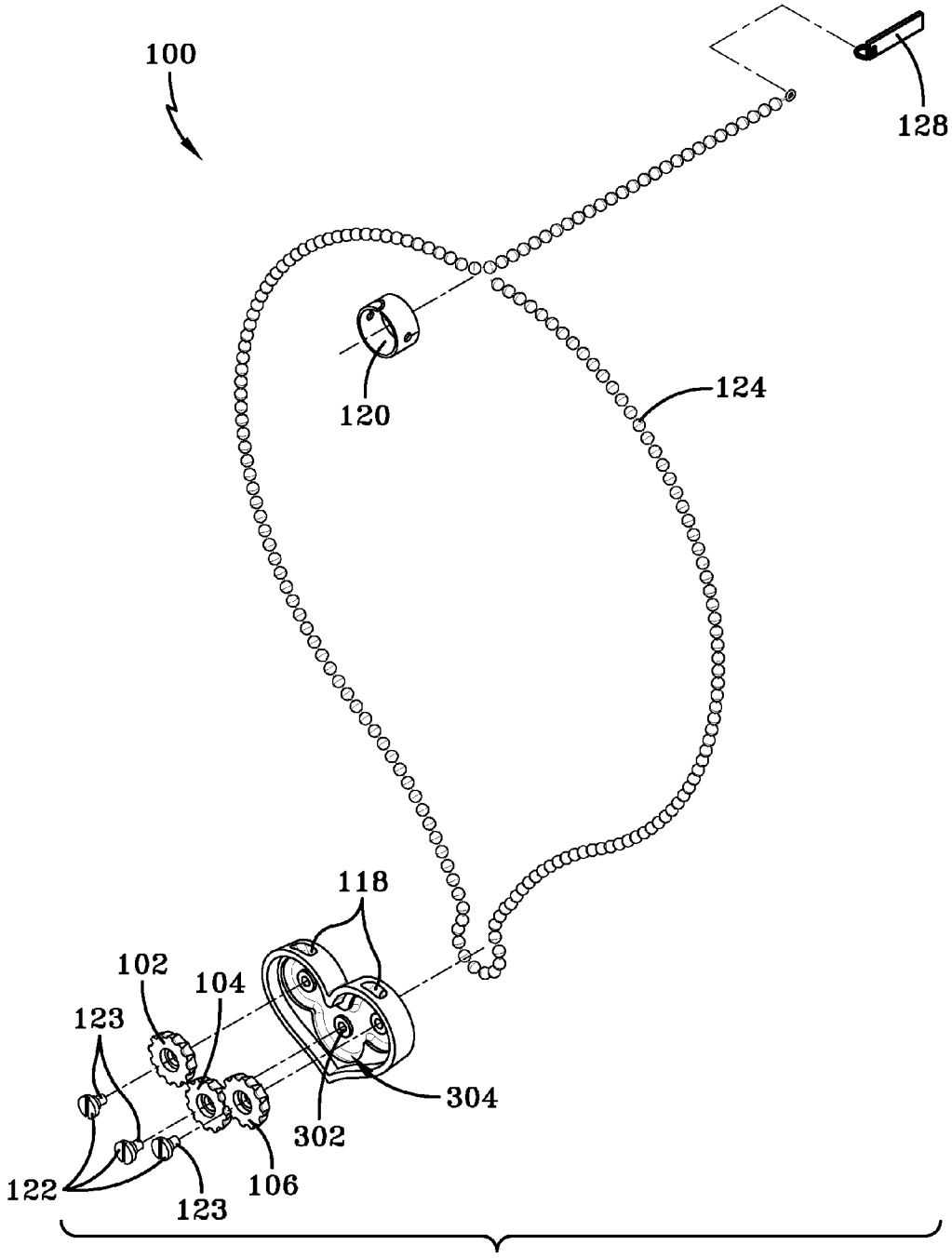
FIG. 3 is a front upper left exploded perspective view of the gear heart necklace shown in FIG. 1.

Referring now to the drawings, FIGS. 1-4; the figures illustrate a necklace 100 comprising a gear assembly housing 114, a driving component 124 and a gear assembly 108. In the preferred embodiment of the necklace 100, the gear assembly housing 114 is heart shaped with a housing wall 402 (FIG. 4) comprising a wall inside surface 130 and a wall outside surface 132 (FIG. 4); a back 206 (FIG. 2) comprising a planar back outside surface 202 and a non-planar back inside surface 304 (FIG. 3). The gear assembly 108 comprises three angular spur gears 102, 104 and 106, along with the driving component 124 being a ball chain, in the preferred embodiment, that passes through housing openings 118 in the housing 114. The necklace 100 also has a clasp 120 for adjusting the length of the driving component usable length around the user's neck, for example. The necklace clasp 120 has a slot 126 for capturing the driving component 124 and a tag 128 for decoration and terminating an end of the driving component 124. Note that the gears 102, 104 and 106 are defined as "angular spur gears" and the driving component 124 is referred to as a ball chain, these components may be referred to with different terms in the art. Angular spur gears 102, 104, and 106 can respectively comprise gear teeth, wherein the respective gear teeth are tapered in width from the front of the tooth which is visible from outside the gear assembly housing 114 to the back of the tooth which is closer to the non-planar back inside surface 304 (FIG. 3); and, they comprise a smaller whole depth at the front of a trough formed between adjacent teeth than at the rear of the trough. Returning to the invention, for example, as the ball chain driving component 124, moves past the angular spur gears 102, 104 and 106 and the angular spur gears 102, 104 and 106 rotate in relation to the ball chain driving component 124. The gears 102 and 106 rotate in an opposite direction as the spur gear 104. Although the inventors in this embodiment are using a ball chain as the driving component 124; one skilled in the art could use other driving components, known by those of skill in the art, comprising braided wire, box chain, linked chain and the like.

In addition, the gear assemblies can comprise wheels and pinions, rack and pinion gears, ring gears, planetary gears, master and servant gears, noncircular gears, face gears, internal and external gears, helical gears, worm gears, bevel gears, non-circular gear rack, internal gears, sprockets, and the like. In addition, the gear assembly housing can have different internal shapes (i.e., where the gears are contained) and different external shapes comprising squares, polygons, other uniform geometrical shapes, a different internal shape than the external shape, ovals, circles, hexagons, rectangles, non-uniform shapes and not depart from the scope of the invention. Those skilled in the art will recognize many modifications that may be made to this configuration, without departing from the scope or spirit of what is described herein.

Once the necklace 100 is assembled, the housing 114 having the rear surface 202 can have exposed gear mounting holes 204 as illustrated in FIG. 2 or the holes 204 can be filled with material and sanded until they are not visible to the naked eye. In addition, once assembled, the rear surface 202 can be modified using known smoothing techniques comprising flattening, pressing, filing, rasping, brushing, sanding, grinding, and other techniques known by those of skill in the art.

Figure 4:
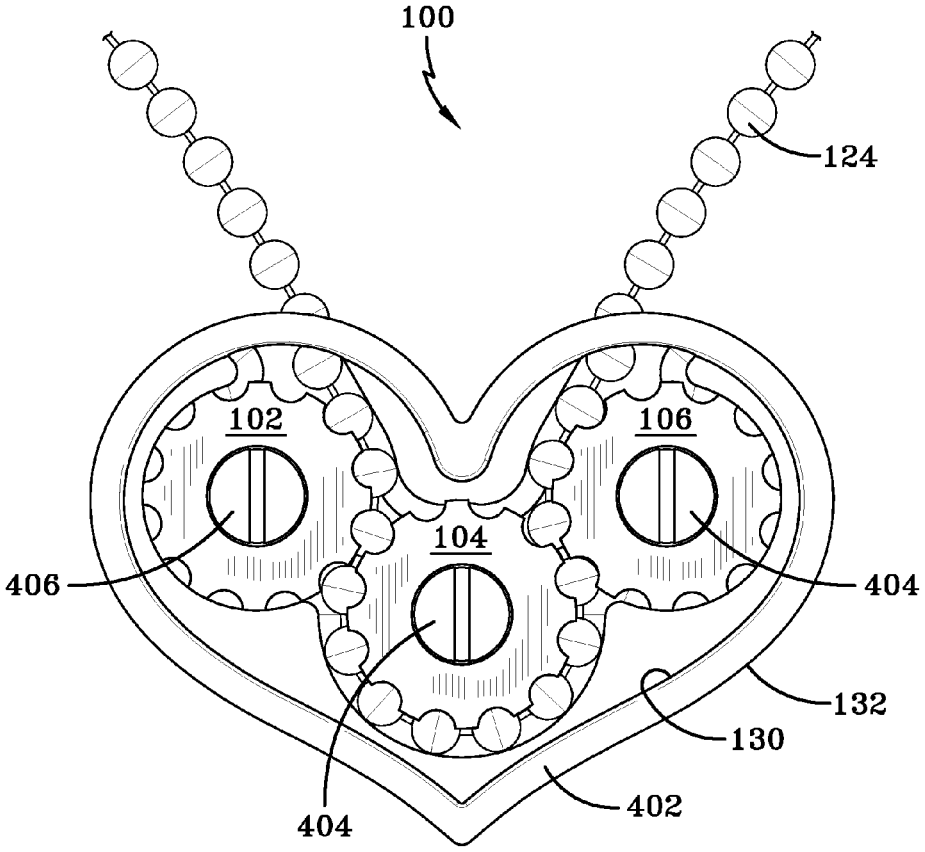
FIG. 4 is a partial front view of the gear heart necklace housing shown in FIG. 1.

Referring now to FIG. 4, illustrated is a portion of the necklace 100 shown in FIG. 1. The necklace 100 comprises the gear assembly 108 (FIG. 1), there the angular spur gears 102 and 106 rotate in an opposite direction as the angular spur gear 104. The gear assembly 108 is driven or manipulated by the driving component 124 such as the ball chain driving component 124.

While the driving component 124 in this embodiment is a ball chain necklace, the inventor(s) has contemplated any other type of device mechanisms well known by those of skill in the art. For example, the driving component can comprise a box, snake, bead and curb chain. Moving a plurality of gears will drive the other geared components of the device. For example, the gears can be multiple sizes, various shaped gears and other combinations known by one of skill in the art. As discussed supra, that although the inventors are utilizing the ball necklace chain as the driving component and gear components as the first, second and third gears, one skilled in the art could use other gears and gear assemblies in similar embodiments and still be within the scope of the invention.

The gear assembly device can also comprise a plurality of gears (e.g., 4, 5, 6 or greater than 6) and an outer base surface that is smooth allowing the user to wear the necklace on their body like a piece of jewelry. Once the necklace is assembled as for example a diamond shaped gear assembly, the outer base surface is sanded until it is substantially smooth to the wearer. The inner base surface provides a base for the rest of the gear device to rest on. The entire necklace can be made of materials comprising any combination of non-uniform or uniform substantially rigid material such as a precious metal, gold, silver, and platinum, any mineral, any precious or non-precious gem stone, alloys, stainless steel, brass, tin, aluminum, plastic, resin, PVC, polypropylene, polycarbonate, or any other machinable material, and the like. Additionally, the scope of the invention contemplates different device elements being made of different materials, for example glass, precious stones, gems and metals in various combinations.

The gears 102, 104 and 106 in the necklace 100 are attached to mechanical standoffs 302 utilizing fasteners 122 inserted through the center of the gears 102, 104 and 106. The insertion end of the fasteners 122 can be configured, for example so that it creates an interference fit with a housing opening 118. The insertion end of the gear fasteners can comprise screws, nails, brads, pins, rivets, dowels, and the like, known by one of skill in the art. In the preferred embodiment, the fastener head 406 is illustrated with a slot 404 for attaching the fastener 122, however the fastener head 406 can comprise a fastener head that is planar, square slotted, Phillips, or other surface known by one of skill in the art.

The drive gear assembly, for example can have a plurality of teeth or cogs used to match up with the teeth or cogs of the gears that drive the rotational movement of the gear assembly. Outer gears can turn in unison when moved along by a necklace causing the rotation of the gear wheels. Gear assemblies may be used to create components/properties comprising an electrical current used for a variety of options such as powering a light or sound attachment without the need for an external power source. Additional embodiments contemplate various configurations comprising the ability to connect a plurality of gears or the face of the gear assembly may have a surface perpendicular or at an angle to the assembly with an additional set of gear assemblies of a variety of designs for rotational or linear movement of the gear elements along the face.

Another embodiment of the invention includes a method of relaxation or therapy. In this embodiment, a device as described supra is worn on around the neck and used as an exercise tool. By using one hand to hold the gear assembly housing and a second hand is on a driving component, the user must concentrate on the task, which requires mental concentration and dexterity. This manipulation is useful as a rehabilitative or preventative form of exercise. Repetitive motion exercise such is created by using the device is also a useful relaxation tool for individuals experiencing stress, anxiety, or for any number of compulsive disorders. Having a wearable device creates a tool that is portable and useful in any situation where other traditional therapies may not be used, such as while riding in a car, sitting in an office and sitting at a desk.

A variety of embodiments for the invention include uses as a decorative interactive piece of jewelry, a toy, an educational tool, and a therapeutic device. As an educational tool, this portable device may be used to educate the user in a manor where they learn how a gear system works by observation and manipulation. By providing an educational tool that is fun and amusing to use, the repetitive motion will constantly reinforce the engineering principle behind the mechanism. For example, the device may be used as a less than traditional token of affection. The gear assembly will not only entertain the wearer, but others who see the gear shaped heart mechanism as well.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described components (assemblies, devices, systems, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application. Furthermore, to the extent that the terms "including", "includes", "having", "has", "with", or variants thereof are used in either the detailed description and the claims, such terms are intended to be inclusive in a similar manner to the term "comprising".

What is claimed is:

1. A necklace, comprising: a gear assembly, and a gear assembly housing comprising a side housing wall surrounding respective sides of the gear assembly and the gear assembly housing comprising a back housing wall comprising a planar back outside surface and a non-planar back inside surface;

wherein the back inside surface is configured with standoffs comprising openings for mounting fasteners to fixedly or non-fixedly attach gears;

wherein the driving component passes through openings sized to merely fit the driving component during operation and disposed in the top side of the side housing wall, and the driving component is non-fixedly disposed between gears, respective gears comprising gear teeth, the respective gear teeth:

tapering in width from the front of the tooth to the back of the tooth; and comprising a smaller whole depth at the front of a trough formed between adjacent teeth than at the rear of the trough; and wherein the gears are configured to rotate when the driving component is moved relative to the gear assembly housing.

2. The necklace of claim 1, wherein the gear assembly comprises one or more of: angular spur gears, cogs, notches, fingers, and cylinders, wheels and pinions, rack and pinion gears, ring gears, planetary gears, master and servant gears, noncircular gears, face gears, internal and external gears, helical gears, worm gears, bevel gears, non-circular gear rack, internal gears, and sprockets; and wherein the gears are mounted to the standoffs utilizing fasteners wherein an insertion end of each fastener is configured to create an interference fit with at least a portion of the back inside surface;

wherein the fasteners comprise one or more of: screws, nails, brads, pins, rivets, and dowels; and wherein the heads of the fasteners comprise at least one of: a planar fastener head, a square slotted fastener head, and a Phillips fastener head.

3. The necklace of claim 1, wherein the driving component comprises one of:

a ball chain necklace, comprising a plurality of ball components;

a bead necklace, comprising a plurality of bead components; and a chain link necklace, comprising a plurality of chain link components.

4. The necklace of claim 1, wherein necklace materials comprise one or more of: precious metals, non-precious metals, gold, silver, platinum, minerals, precious gem stones, non-precious gem stones, alloys, stainless steel, brass, tin, aluminum, plastic, resin, PVC, polypropylene, polymers, and polycarbonate.

5. The necklace of claim 1, wherein the gear assembly housing, comprises one or more of: a heart shape, a diamond shape, a star shape, a moon shape, and a triangular shapes.

6. The necklace of claim 1, wherein the necklace comprises a piece of jewelry, a piece of body art, a bracelet, an anklet, a necklace, a charm, and a brooch.

7. The necklace of claim 1, wherein the necklace comprises a toy.

8. The necklace of claim 1, wherein the necklace is used for maintaining attention, exercising, or improving motor or cognitive skills.

9. The necklace of claim 1, wherein the necklace is used as a portable relaxation aid.

10. The necklace of claim 1, wherein the necklace is used as a part of a therapeutic treatment.

11. The necklace of claim 1, wherein the necklace is used as an educational tool.

12. The necklace of claim 1, wherein the gears are configured to selectably secure at least a portion of a component of the driving component between the gear and the back inside surface, thereby mitigating uncoupling of the driving component from the gears while disposed in the gear assembly housing.

* * * * *